United States Patent [19]

Shanton

[11] Patent Number: 4,567,498

[45] Date of Patent: Jan. 28, 1986

[54] RECORD MATERIAL

[75] Inventor: Kenneth J. Shanton, Beaconsfield, England

[73] Assignee: The Wiggins Teape Group Limited, Hampshire, England

[21] Appl. No.: 621,195

[22] Filed: Jun. 15, 1984

[30] Foreign Application Priority Data

Jun. 15, 1983 [GB] United Kingdom ..... 8316232

[51] Int. Cl.[4] ..... B41M 5/16; B41M 5/18; B41M 5/22

[52] U.S. Cl. ..... 346/216; 346/225; 427/150; 427/151

[58] Field of Search ..... 346/210–212, 346/216, 217, 225

[56] References Cited

U.S. PATENT DOCUMENTS

| | | | |
|---|---|---|---|
| 2,663,656 | 12/1953 | Miller et al. | 428/913 |
| 3,432,327 | 3/1969 | Kau et al. | 346/200 |
| 4,124,227 | 11/1978 | Ruus | 346/218 |
| 4,315,068 | 2/1982 | Kunikane et al. | 430/341 |
| 4,351,956 | 9/1982 | Cesark et al. | 427/150 |

FOREIGN PATENT DOCUMENTS

| | | | |
|---|---|---|---|
| 0035773 | 9/1981 | European Pat. Off. | 346/218 |
| 2161202 | 6/1972 | Fed. Rep. of Germany | 346/214 |
| 2353525 | 5/1977 | France | 346/218 |
| 1373527 | 11/1974 | United Kingdom | 346/214 |

*Primary Examiner*—Bruce H. Hess

*Attorney, Agent, or Firm*—Burns, Doane, Swecker & Mathis

[57] ABSTRACT

Record material of the type in which the color forming reaction is between an electron donating chromogenic material and an electron accepting color developer uses one or more oximes as the color developer. Preferred oximes are monoximes, especially salicylaldoxime and its ring substituted derivatives, and dioximes such as dimethylglyoxime and mioxime.

7 Claims, No Drawings

RECORD MATERIAL

This invention relates to pressure and heat sensitive record material. In particular it relates to such record material including one or more oximes as an electron accepting colour developer.

Pressure sensitive record material generally employs a colour forming reaction involving a substantially colourless chromogenic material, a colour developer capable of reacting with the chromogenic material to produce a colour, and a solvent in which the colour forming reaction can take place. The reactive components of the colour forming reaction are kept apart by a pressure sensitive barrier until such time as the record material is used. The barrier may be a continuous honeycombed structure but more usually takes the form of microcapsules. In either case, a solvent solution of one of the reactive components, normally the chromogenic material, can be isolated within the honeycombed structure or the microcapsules. In use, the application of pressure to the record material causes rupture of the barrier in the area immediately subject to such pressure and subsequent release of the solvent solution of one of the reactive components. The solution then reacts with the other of the reactive components to produce a coloured image which corresponds to the pattern of applied pressure. In this way, pressure sensitive record material can be used to provide copies without the need for carbon paper.

With a self-contained record system, the record material comprises a sheet coated, or having dispersed within, a mixture of the chromogenic material and the colour developer, one of which is isolated as a solvent solution from the other by a pressure sensitive barrier. With a transfer record system, the record material comprises at least two sheets—the transfer or "coated back" (CB) and the record receiving or "coated front" (CF) sheet. The CB sheet is coated with a solvent solution of one of the reactive components, the solution being isolated by a pressure sensitive barrier, and the CF sheet is coated with the other of the reactive components. The CB and CF sheets are assembled together with their coatings in contiguous relationship so that transfer of the solvent solution can take place from the CB to the CF sheet. Further copies can be obtained by including further sheets which are coated on one side with a solvent solution of one of the reactive components, the solution being isolated by a pressure sensitive barrier, and coated on the other side with the other of the reactive components. Such sheets, which are referred to as "coated front and back" (CFB) sheets, are placed between the CB and CF sheets with each coating of one of the reactive components being in contiguous relationship with a coating of the other of the reactive components. If the reactive component which is isolated as a solvent solution by a pressure sensitive barrier is the chromogenic material, the system is the normal transfer record system. If, however, the isolated reactive component is the colour developer, the system is then referred to as the reverse transfer record system.

Heat sensitive record material employs a colour forming reaction that is responsive to a temperature change. The reactive components of the colour forming reaction include a substantially colourless chromogenic material or the colour developer or another component, such as a wax, being capable of melting and/or vaporising at an elevated, thermographically suitable temperature to allow reaction of the chromogenic material and the colour developer to proceed. Heat sensitive record material comprises a sheet having a coating in which both reactive components are dispersed in a binder. In use a suitable imaging tool is applied to the coated surface of the record material and, at an elevated temperature, produces a coloured image which corresponds to the pattern of applied heat.

There are many chromogenic materials known for use in pressure and heat sensitive colour forming reactions. These materials are organic compounds which develop their coloured form by acquiring a positive charge engendered by the colour developer. Important examples include the organic phthalides, fluorans, di- and tri-arylmethanes, spirodipyrans and benzoyl phenoxazines and phenothiazines. In addition, it is known that certain derivatives of oximes are useful as chromogenic material (European patent Ser. No. 35773). Suitable colour developers for such chromogenic materials are also known. In the case of pressure sensitive colour forming systems, there are phenolic resins, acidic clays and salicylic acid derivatives. In the case of heat sensitive colour forming systems, there are notably phenolic compounds.

In addition, a further pressure sensitive colour forming reaction is known in which colour formation is achieved by reaction of a metal cation, usually a transition metal cation, with a chelating agent to give a coloured metal complex. Examples of suitable chelating agents include various oximes (U.S. Pat. No. 2,663,656 and Japanese patent publications No. 49-43566 and No. 50-16970). The term "chromogenic material" is not normally applied to any of the components of this type of system.

It has now been found that oximes are useful colour developers of the aformentioned chromogenic materials and are suitable for use in both pressure and heat sensitive record materials.

The present invention therefore provides pressure sensitive record material in which the colour forming reaction is produced from a substantially colourless chromogenic material capable of acquiring a positive charge to produce its coloured form and an oxime colour developer capable of engendering the acquisition of a positive charge by the chromogenic material, the chromogenic material and the colour developer being isolated from each other by a pressure sensitive barrier.

The present invention also provides heat sensitive record material in which the colour forming reaction is produced from a substantially colourless chromogenic material capable of acquiring a positive charge to produce its coloured form and an oxime colour developer capable of engendering the acquisition of a positive charge by the chromogenic material, the chromogenic material or the colour developer or another component, such as a wax, being capable of melting and/or vaporising at a thermographically suitable temperature to allow the colour forming reaction to take place.

The oxime(s) used in the present invention can be a monoxime or a dioxime. A preferred class of monoxime colour developers is of formula (1), $$(R_1)(R_2).C{=}N{-}OH \qquad (I)$$

wherein $R_1$ and $R_2$ are the same or different and each represents a hydrogen atom; an alkyl group; an aryl, especially a phenyl or naphthyl, group which is optionally substituted by one or more hydroxy and/or one or more alkyl and/or aralkyl and/or alkoxy and/or halo substituent(s); an aroyl group; an acyl group; an aralkyl group, especially a 1-aryl-1-hydroxymethyl group, a hydroxy group or $R_1$ and $R_2$ together with the carbon atom to which they are bonded represent an alicyclic, or heterocyclic ring which can be aromatic or non-aromatic and preferably contains 5 or 6 atoms in the ring.

A preferred class of dioxime colour developers is of formula (II)

$$HO—N{=}C(R_3)—C(R_4)C{=}N—OH \quad (II)$$

wherein $R_3$ and $R_4$ are the same or different and each represents a hydrogen atom; an alkyl group; an aryl, preferably phenyl, group; or a furyl group; or $R_3$ and $R_4$ together represent a $C_1$ to $C_{10}$, preferably a $C_3$ to $C_5$, and especially a $C_4$, alkylene group.

The alkyl groups or the alkyl moieties of alkyl-containing groups used in the oximes of formulae (I) and (II) usually have from 1 to 20, for example from 1 to 12, and 1 to 5, carbon atoms. Such groups or moieties moreoever may have straight or preferably branched chains, such as t-nonyl or t-butyl. Of the straight chain groups or moieties, methyl is generally preferred. Where the alkyl group(s) in a substituent in an aryl group attached to the oxime function, the alkyl group(s) may be long chain e.g. $C_{10}$ to $C_{20}$, straight or branched, alkyl groups.

Examples of suitable oximes of the formula (I) include acetoxime (acetone oxime), acetaldoxime (acetaldehyde oxime), acetophenone oxime, biacetyl monoxime(2,3-butanedione 2-oxime), cyclohexanone oxime, benzoin oxime, 1-phenyl-1,2-propanedione 2-oxime, 2-hydroxyphenyl oximes such as salicylhydroxamic acid(N,2-dihydroxybenzamide) and salicylaldoxime, and espcially their 3-,5- and 3,5-dialkyl and aralkyl substituted derivatives e.g. 2-hydroxy-5-t-nonylacetophenone oxime and 3,5-di-t-butyl salicylaldoxime, and violuric acid (5-oximinobarbituric acid or 2,4,5,6(1H,3H)-pyrimidinetetrone 5-oxime).

Examples of suitable oximes of formula (II) include glyoxime (glyoxal dioxime or ethanedione dioxime), dimethylglyoxime(2,3-butadione dioxime), diphenylglyoxime(benzil dioxime or 1,2-diphenylethanedione dioxime), alpha-furildioxime(di-2-furanylethanedione dioxime) and 1,2-cyclohexanedione dioxime (commonly known as nioxime).

The most preferred oximes are monoximes of the formula (I) in which one of $R_1$ and $R_2$ is a hydroxyphenyl, preferably a 2-hydroxyphenyl, most preferably a 3-,5- or 3,5-di-alkyl, preferably branched chain $C_3$ to $C_{10}$, or di-aralkyl, preferably alpha-phenylalkyl, substituted 2-hydroxyphenyl, group and the other is alkyl or, preferably, hydrogen. Especially preferred are the oximes of salicylaldehyde and its ring-substituted derivatives.

A large number of the oximes of formulae (I) and (II) are known and commercially available, for example as metal extractants. Those that are not can be prepared in an analogous manner to the preparation of the known oximes. Generally this involves the treatment of the corresponding carbonyl-containing compound with hydroxylamine. The aldehyde or ketone can in turn be prepared by published synthetic routes.

A single oxime or a combination of different oximes may be used as the colour developer in the present invention. Moreover, one or more oximes may be used with one or more other, known colour developers, such as acidic clays, phenolic resins and salicylic acids.

The amount of oxime used as a colour developer will typically be in the range 0.05 to 3 $gm^{-2}$, more usually 0.1 to 1.5 and 0.3 to 1 $gm^{-2}$. The optimum may vary within the broad limits depending on the configuration of the system (pressure sensitive—normal transfer, reverse transfer or self contained—or heat sensitive) and the other materials present. As the quantities of oxime are relatively small, direct coating onto a substrate e.g. to make a CF sheet, can be difficult to achieve uniformly and, accordingly, the oximes will usually be coated in conjunction with a carrier. For CF sheets the oxime will usually be coated or deposited onto the carrier e.g. by solvent evaporation deposition or precipitation. For heat sensitive sheets the oxime and carrier will typically be co-dispersed. Suitable carriers include inert inorganic and organic particulate materials, especially pigments, such as china clay, talc, alumina, and agglomerated cross-linked urea-formaldehyde resin pigments. The oxime will usually be from 1 to 20% by weight of the carrier. The carrier and oxime can be coated onto the substrate using conventional binders such as starch, styrene-butadiene latex and, particularly for heat sensitive record material thermofusible binders such as polyvinyl alcohol. The overall coatweight will typically be from 3 to 15 more usually 5 to 10 $gm^{-2}$.

The other reactive component to be used in the colour forming reaction with the oxime colour developer is the substantially colourless chromogenic material. The present invention is not limited to any particular type of chromogenic material as long as its coloured form is dependent on the acquisition of a positive charge in the presence of the colour developer. Suitable chromogenic materials include azacyclic furanones such as 7-(1-ethyl-2-methylindol-3-yl)-7-(4-diethylamino-2-ethoxyphenyl)-5,7-dihydrofuro[3,4-b]pyridin-5-one (pyridyl blue), diarylmethane derivatives such as Michler's hydrol para-toluene sulphonate, (bis-(4-dimethylaminophenyl)methane 4-methylbenzene sulphonate), fluorans such as 3-cyclohexylamino-6-chlorofluoran, 3-diethylamino-7,8-benzofluoran, 3-diethylamino-6-methyl-7-chlorofluoran, and including in particular 3,7-diamino-substituted fluorans such as 3-diethylamino-6-methyl-7-N-phenylaminofluoran (N-102), 3-N-ethyl-N-(4-methylphenyl)amino-6-methyl-7-N-phenylaminofluoran, 3-N-ethyl-N-(4-methylphenyl)amino-7-N-phenylaminofluoran and 3-diethylamino-7-dibenzylaminofluoran, phthalides such as 3,3-bis-(4-dimethylaminophenyl)-6-dimethylaminophthalide (CVL), 3,3-bis-indolyl phthalides such as 3,3-bis-(1-ethyl-2-methylindol-3-yl)phthalide, (Indolyl Red), 3,3-bis-(1-n-octyl-2-methylindol-3-yl)phthalide, 3,3-bis-indolyltetrachlorophthalides such as 3,3-bis-(1-ethyl-2-methylindol-3-yl)-4,5,6,7-tetrachlorophthalide (and its 1-n-octyl analogue) triarylmethane derivatives such as those disclosed in U.S. Pat. No. 4,154,463, for example di-(4-N-methyl-N-phenylaminophenyl)-N-butylcarbazol-3-yl methane (DMBM), phenoxazines such as 3,7-bis-diethylamino-10-benzoylphenoxazine (BLASB), phenothiazines such as 3,7-bis-dimethylamino-10-benzoylphenothiazine (BLMB), substituted pyridines such as 2,6-diphenyl-4-(4-N-methyl-N-phenylaminophenyl)-pyridine, Rhodamine derivatives such as the N-(2- or 4-chlorophenyl)derivatives of Rhodamine-B-lactam (N-(2- or 4-)chlorophenyl-3,4'-spiro(3,6'-bis(diethylamino)xanthane)phthalan), chromenopyrazoles such as those disclosed in British Pat. No. 1469515 and spirodipyrans such as those disclosed in British Pat. No. 1460503 and European Patent Specification No. 0010740, for example 3'-phenyl-7-diethylamino-2,2'-spiro-di-(2H-1-benzopyran) (PDSB).

To obtain an image with the desired colour and physical characteristics, the record material customarily and pressure sensitive record material in particular uses a combination of different chromogenic materials each contributing to the overall effect. Thus for a blue image, a combination of CVL, which is a fast developing blue chromogenic material but which also fades relatively quickly, with BLMB, which is a slow developing blue chromogenic material that does not fade so quickly, is often used. And to obtain an image with other desired characteristics, such as photocopiability, a green and/or a red chromogenic material are sometimes used as well.

The present invention extends to the use of combinations of chromogenic materials as well as to the use of single chromogenic materials.

With pressure sensitive record material embodying the aforementioned self-contained and normal transfer systems, and also using the much preferred microcapsular form of pressure sensitive barrier, the chromogenic material, alone or with other chromogenic materials, is normally dissolved in a suitable organic solvent prior to microencapsulation. Examples of such solvents which may optionally be used in combination include dialkyl phthalates such as diethyl, dibutyl, dioctyl, dinonyl and ditridecyl phthalates, partially hydrogenated terphenyls, alkylated naphthalenes, 2,2,4-trimethyl-1,3-pentanediol di-isobutyrate (TXIB, U.S. Pat. No. 4,027,065), ethyl-diphenylmethane (U.S. Pat. No. 3,996,405), alkyl biphenyls such as mono-isopropyl-biphenyl (U.S. Pat. No. 3,627,581), higher alkyl benzenes such as dodecyl benzene, diaryl ethers such as diphenyl ether, di(aralkyl) ethers, such as dibenzyl ether, aryl aralkyl ethers such as phenyl benzyl ether, liquid dialkyl ethers having at least eight carbon atoms, liquid alkyl ketones having at least nine carbon atoms, alkyl or aralkyl benzoates such as benzyl benzoate, trialkylphosphates, kerosene and Magnaflux oil, which is a mixture of saturated aliphatic hydrocarbon oils having a distillation temperature in the range of from 320° to 550° F. (160° to 288° C.). Of course, the solvent should not only be capable of dissolving the chromogenic material but should also be able to maximise contact between the chromogenic material and the oxime colour developer so as to permit the colour forming reaction to proceed. The preferred solvents for use with the present invention include partially hydrogenated terphenyl and dialkylphthalates. Optionally these solvents are used in combination with a diluent such as kerosene.

The chromogenic solution is microencapsulated in accordance with processes known in the art, such as those disclosed in U.S. Pat. Nos. 2,800,457, 3,041,289, 3,533,958, 3,755,190, 4,001,140, 4,100,103 and 4,105,823. Coating formulations and processes for the preparation of pressure sensitive record material are known in the art, for example U.S. Pat. Nos. 3,627,581, 3,775,424 and 3,853,869.

The present invention also provides pressure sensitive record material embodying the normal transfer system, which comprises a transfer sheet coated with a microencapsulated solution of a substantially colourless chromogenic material capable of acquiring a positive charge to produce its coloured form and a record receiving sheet coated with an oxime colour developer capable of engendering the acquisition of a positive charge by the chromogenic material.

The oxime colour developers are also suitable for use in pressure sensitive record material embodying the reverse transfer system, as described in British Pat. No. 1337924. Thus the present invention provides pressure sensitive record material, which comprises a transfer sheet coated with a microencapsulated solution of an oxime colour developer and a record receiving sheet coated with a substantially chemically inert pigment on which is adsorbed a substantially colourless chromogenic material capable of acquiring a positive charge in the presence of the colour developer to produce its coloured form the transfer and record receiving sheets being arranged with the coatings in contiguous relationship.

With heat sensitive record material, coating formulations and processes for its production are generally known in the art, for example U.S. Pat. Nos. 3,539,375, 3,674,535 and 3,746,675. In this regard, the present invention provides heat sensitive record material which comprises a sheet coated with a thermally responsive composition containing a substantially colourless chromogemic material capable of acquiring a positive charge to produce its coloured form and an oxime colour developer capable of engendering the acquisition of a positive charge by the chromogenic material, the chromogenic material or the colour developer or another component, such as a wax, being capable of melting and/or vaporising at a thermographically suitable temperature to allow the colour forming reaction to take place.

The invention is illustrated by the following Examples. All parts and precentages are by weight unless otherwise stated. The C.O.I Reflectometer used in the Examples is as described in U.K. Patent Specification No. 2054845A.

EXAMPLE 1

Two coating formulations were made up with the following ingredients:

| Ingredient | Amount (parts) A | Amount (parts) B |
|---|---|---|
| Salicylaldoxime | 13.1 | 7.9 |
| Dinkie A (china clay) | 40.5 | 40.5 |
| Dow latex binder | 5.4 | 4.8 |
| Water | 71.0 | 71.0 |

Formulations A and B were ball-milled for one hour, adjusted to a pH of 7.0 and then coated on to sheet paper with a laboratory Meyer coater. The resulting coated sheets, A and B were oven dried to give dry coatweights of between 8 and 9 $gm^{-2}$.

A solution of CVL in a 2:1 mixture of partially hydrogenated terphenyl and kerosene was then applied with a gravure coater to each of the coated sheets A and B. After two minutes the reflectance of the resulting blue image was measured together with the reflectance of the unimaged area with a C.O.I Reflectometer. The colour intensity (C.I.) of the image was determined by dividing the reflectance of the imaged area by the reflectance of the unimaged area and expressing the result as a percentage. The lower the percentage, the more intense the developed colour. For sheet A, the C.I. was 38.1 and for sheet B, 44.5.

EXAMPLE 2

The colour forming reaction between an oxime and a chromogenic material was further investigated by placing 0.1 g of each of various oximes on a spotting tile and then contacting it with a 1% chromogenic solution of one of CVL, N-102, PDSB and DBDM in one of the following solvents:

A: 4:1 Partially hydrogenated terphenyl:Kerosene
B: 2:1 Partially hydrogenated terphenyl:Kerosene
C: 2:1 Dioctylphthalate:Kerosene
D: Chloroform
E: 14:3:3 Kerosene:Diethylphthalate:Tributylphosphate Colour formation occurred in every instance and the intensity was visually assessed two minutes from contact on a scale from 1 to 3. The higher the number, the higher the intensity. The results are set out in Table 1 below.

EXAMPLE 3

Various combinations of two oximes in 1:1 molar ratio were tested by placing a sample (0.1 g) of the oxime mixture on a white card and contacting it with a 1% solution of CVL, N-102 or BLASB in one of solvents B, C or D from Example 2 or solvent F: toluene.

Colour formation occurred in every case and the intensity was visually assessed as described in Example 2. The coloured samples were then placed in a fade cabinet containing an array of six fluorescent light tubes positioned above the samples. After 3 hours, the samples were removed and the intensity of the colour was visually assessed on the same scale. The results are set out in Table 2 below, the faded results being bracketed.

EXAMPLE 4

This Example illustrates the use of oximes as co-reactants in heat sensitive record material. Three dispersions were made up as follows:

| | | Amount (parts) |
|---|---|---|
| Dispersion A: | | |
| | CVL | 14 |
| | 10% Aqueous Polyvinyl Alcohol (PVA) | 60 |
| | Water | 26 |
| Dispersion B: | | |
| | Talc pigment | 14 |
| | 10% Aqueous PVA | 60 |
| | Water | 26 |
| Dispersion C: | | |
| | 3,5-Di-t-butylsalicyl-aldoxime | 14 |
| | 10% Aqueous PVA | 60 |
| | Water | 26 |

The three dispersions were separately ground in a ball mill to reduce the particle size for coating on paper. A coating mix was made up by mixing 1 part of Dispersion A with 13 parts of Dispersion B and then mixing in 9 parts of Dispersion C. This coating mix was coated onto base paper and the coated paper dried in a current of air at 40° C. The dry coated paper had a coatweight of 7 $gm^{-2}$. The coated paper was tested by contacting it with a hot stylus which produced a clear blue image immediately on contact.

TABLE 1

| OXIME | CVL | N102 | PDSB | DMBM |
|---|---|---|---|---|
| 1. Acetone oxime | A-1 | A-1 | | |
| 2. Acetaldehyde oxime | B-1 | B-2 | | |
| | C-2 | C-2 | | |
| | | E-2 | | |
| 3. Acetophenone oxime | D-1 | B-1 | | |
| | | D-1 | | |
| 4. Biacetyl-monoxime | A-1 | A-1 | A-1 | B-1 |
| | B-1 | B-1 | B-1 | C-2 |
| | D-1 | C-1 | C-2 | D-2 |
| | | D-3 | D-3 | |
| | | E.1 | | |
| 5. 1-Phenyl-1,2-propanedione -2-oxime | D-1 | D-1 | D-1 | D-1 |
| 6. Violuric acid | | D-1 | | A-1 |
| | | | | D-1 |
| 7. Alpha-furildioxime | A-1 | A-1 | C-1 | |
| | | B-1 | D-1 | |
| | | D-3 | | |
| | | E-1 | | |
| 8. Dimethylglyoxime | | D-1 | | |
| 9. Diphenylglyoxime | D-2 | A-1 | A-1 | D-2 |
| | | B-1 | B-1 | |
| | | D-2 | C-1 | |
| | | E-1 | D-1 | |
| 10. Glyoxime | | A-1 | B-1 | |
| | | B-1 | D-1 | |
| | | C-1 | | |
| | | D-1 | | |
| | | E-1 | | |
| 11. Nioxime | | D-1 | | |
| 12. 2-Hydroxy-5-t-nonyl-acetophenone oxime | B-1 | A-1 | A-1 | |
| | D-3 | C-1 | D-1 | |
| | | D-3 | | |
| | | E-1 | | |
| 13. Salicylaldoxime | A-3 | A-3 | A-3 | A-3 |
| | B-3 | B-3 | B-3 | |
| | C-3 | C-3 | C-3 | |
| | D-3 | D-3 | D-3 | D-1 |
| | E-3 | E-3 | E-1 | E-1 |
| 14. Salicylhydroxamic acid | A-1 | B-3 | A-2 | A-3 |
| | B-1 | C-2 | B-2 | B-2 |
| | C-1 | D-1 | C-2 | C-1 |
| | D-3 | | D-3 | D-3 |
| 15. Benzoinoxime | A-1 | A-1 | B-1 | B-1 |
| | C-1 | B-1 | D-1 | C-1 |
| | D-1 | D-1 | | D-1 |

TABLE 2

| OXIME COMBINATION | CVL | N102 | BLASB |
|---|---|---|---|
| 1. Biacetyl monoxime and diphenyl glyoxime | D-3(1) | B-2(3) | B-0(3) |
| | F-3(1) | C-1(1) | C-0(3) |
| | | D-3(3) | E-0(2) |
| | | F-3(2) | |
| 2. Diphenyl glyoxime and salicylaldoxime | B-3(3) | B-3(3) | B-1(3) |
| | C-3(3) | C-3(3) | C-1(3) |
| | D-3(3) | D-3(3) | D-1(3) |
| | F-3(3) | F-3(3) | F-1(2) |
| 3. Biacetyl monoxime and salicylaldoxime | B-3(3) | B-3(3) | B-0(3) |
| | C-3(3) | C-3(3) | C-1(3) |
| | D-3(3) | D-3(3) | D-1(3) |
| | F-3(3) | F-3(3) | F-1(3) |
| 4. Benzoin oxime and biacetyl monoxime | B-1(1) | B-1(1) | B-0(2) |
| | D-2(2) | D-3(2) | C-0(2) |
| | F-2(2) | F-3(1) | D-0(1) |
| 5. Diphenyl glyoxime and benzoin oxime | D-1(1) | B-1(2) | B-0(3) |
| | F-1(1) | C-1(1) | C-0(3) |
| | | D-3(3) | D-0(3) |
| | | F-2(2) | F-0(2) |
| 6. Benzoin oxime and salicylaldoxime | B-3(3) | B-3(3) | B-1(3) |
| | C-3(3) | C-3(3) | C-1(3) |
| | D-3(3) | D-3(3) | D-1(3) |
| | F-3(3) | F-3(3) | F-1(3) |

I claim:

1. Pressure sensitive record material in which the colour forming reaction is produced from a substantially colourless chromogenic material capable of acquiring a positive charge to produce its coloured form and an oxime colour developer capable of engendering the acquisition of a positive charge by the chromogenic material, the chromogenic material and the colour developer being isolated from each other by a pressure sensitive barrier.

2. Record material as claimed in claim 1 wherein the oxime is a monoxime of the formula (I):

$$(R_1)(R_2).C{=}N{-}OH \quad (I)$$

wherein $R_1$ and $R_2$ are the same or different and each represents a hydrogen atom; an alkyl group; an aryl group which is optionally substituted by one or more hydroxy and/or one or more alkyl and/or aralkyl and/or alkoxy and/or halo substituent(s); an aroyl group; an acyl group; an aralkyl group; a hydroxy group or $R_1$ and $R_2$ together with the carbon atom to which they are bonded represent an alicyclic, or heterocyclic ring which can be aromatic or non-aromatic.

3. Record material as claimed in claim 1 wherein the oxime is a dioxime of the formula (II):

$$HO{-}N{=}C(R_3){-}C(R_4)C{=}N{-}OH \quad (II)$$

wherein $R_3$ and $R_4$ are the same or different and each represents a hydrogen atom; an alkyl group; an aryl group; or a furyl group; or $R_3$ and $R_4$ together represent a $C_1$ to $C_{10}$ alkylene group.

4. Record material as claimed in claim 3 wherein the oxime is salicylaldoxime or a ring-substituted derivative thereof.

5. Heat sensitive record material in which the colour forming reaction is produced from a substantially colourless chromogenic material capable of acquiring a positive charge to produce its coloured form and an oxime colour developer capable of engendering the acquisition of a positive charge by the chromogenic material, the chromogenic material or the colour developer or another component being capable of melting and/or vaporising at a thermographically suitable temperature to allow the colour forming reaction to take place.

6. Record material as claimed in claim 5 wherein the oxime is a monoxime of the formula (I):

$$(R_1)(R_2).C{=}N{-}OH \quad (I)$$

wherein $R_1$ and $R_2$ are the same or different and each represents a hydrogen atom; an alkyl group; an aryl group which is optionally substituted by one or more hydroxy and/or one or more alkyl and/or aralkyl and/or alkoxy and/or halo substituent(s); an aroyl group; an acyl group; an aralkyl group; a hydroxy group or $R_1$ and $R_2$ together with the carbon atom to which they are bonded represent an alicyclic, or heterocyclic ring which can be aromatic or non-aromatic.

7. Record material as claimed in claim 5 wherein the oxime is a dioxime of the formula (II):

$$HO{-}N{=}C(R_3){-}C(R_4)C{=}N{-}OH \quad (II)$$

wherein $R_3$ and $R_4$ are the same or different and each represents a hydrogen atom; an alkyl group; an aryl group; or a furyl group; or $R_3$ and $R_4$ together represent a $C_1$ to $C_{10}$ alkylene group.

* * * * *